US005595339A

United States Patent [19]

Correll

[11] Patent Number: 5,595,339

[45] Date of Patent: Jan. 21, 1997

[54] BLANK FOR ONE-PIECE OCTAGONAL BOX

[76] Inventor: John D. Correll, 8459 Holly Dr., Canton, Mich. 48187

[21] Appl. No.: 527,851

[22] Filed: Sep. 14, 1995

Related U.S. Application Data

[63] Continuation-in-part of Ser. No. 145,248, Nov. 1, 1993, abandoned, and Ser. No. 311,396, Sep. 23, 1994, which is a continuation of Ser. No. 86,318, Jul. 6, 1993, abandoned, and Ser. No. 29,195, Sep. 30, 1994, Pat. No. Des. 371,296.

[51] Int. Cl.[6] ..... B65D 5/22

[52] U.S. Cl. ..... 229/109; 229/150; 229/151; 229/933; 229/935; 229/936

[58] Field of Search ..... 229/109, 150, 229/933, 935, 936, 151

[56] References Cited

U.S. PATENT DOCUMENTS

| | | | |
|---|---|---|---|
| 1,634,596 | 7/1927 | Schurmann . | |
| 2,210,443 | 8/1940 | Bergstein | 229/935 |
| 2,706,592 | 4/1955 | Schaller | 229/23 |
| 2,751,138 | 6/1956 | Laver | 229/109 |
| 2,819,833 | 1/1958 | Sauer | 229/109 |
| 2,925,213 | 2/1960 | Zukoski | 229/109 |
| 3,003,674 | 10/1961 | Ringler | 229/936 |
| 3,003,675 | 10/1961 | Ringler | 229/33 |
| 3,512,697 | 5/1970 | Robinson | 229/39 |
| 3,572,576 | 5/1971 | Foster | 229/31 |
| 4,171,763 | 10/1979 | Card | 229/150 |
| 4,620,666 | 10/1986 | Lacasa et al. | 229/151 |
| 4,765,534 | 8/1988 | Zion et al. | 229/109 |
| 4,793,546 | 12/1988 | Nunn | 229/109 |
| 5,000,374 | 3/1991 | Deiger | 229/109 |
| 5,118,032 | 6/1992 | Geho | 229/150 |
| 5,211,329 | 5/1993 | Patton | 229/150 |
| 5,351,880 | 10/1994 | Goudreau | 229/120 |
| 5,358,173 | 10/1994 | Mertz | 229/150 |
| 5,402,929 | 4/1995 | Ritter | 229/150 |

FOREIGN PATENT DOCUMENTS 680781 1/1965 Italy .

OTHER PUBLICATIONS

Photo 1: A Blank for an Octagonal Box Used by a Pizza Company–Photographed by John Correll, Sep. 12, 1995.

*Primary Examiner*—Stephen P. Garbe

[57] ABSTRACT

A blank for a one-piece octagonal pizza box that uses a minimum of material and that can be manufactured in multiple units in inverted-and-mated configuration for substantial savings in material and cost.

15 Claims, 4 Drawing Sheets

12
128
61
62
126
55
52
56
126
73
75
53
60
54
74
76
57
58
64
63
51
37
38
30
21
124
27
28
23
20
24
33
34
25
43
26
40
22
130
41
32
131
45
46
42
132
35
36

BLANK FOR ONE-PIECE OCTAGONAL BOX

CROSS-REFERENCES TO RELATED APPLICATION

This application is a continuation-in-part of application Ser. No. 08/145,248, filed Nov. 1, 1993, now abandoned; application Ser. No. 08/311,396, filed Sep. 23, 1994, which is a continuation of application Ser. No. 08/086,318, filed Jul. 6, 1993, now abandoned; and application Ser. No. 29,029,195, filed Sep. 30, 1994, now U.S. Pat. No. D. 371,296.

FIELD OF THE INVENTION

This invention relates to box blanks made of foldable material and, in particular, to blanks for one-piece octagonal (i.e., 8-sided) boxes for relatively flat food products such as pizza and the like.

DESCRIPTION OF THE PRIOR ART

In the pizzeria industry, the cost of the box for delivery/carry-out pizza amounts to a substantial part of the total cost of the product. Therefore, a pizza box blank must be economical to produce.

Several factors affect the cost of a box blank. One factor is whether it's a one-piece design, where the cover and box base are hingedly attached, versus a two-piece design, where the cover and box base are separate units. It is advantageous for a particular pizza box blank to be of one-piece design because a one-piece design consumes less material than a two-piece design of similar shape. In addition, a one-piece box is easier to close, has greater rigidity, and is less prone to accidental cover opening than a two-piece box.

Another factor affecting the cost of a box blank is its overall length and width. A blank that has a flap projecting from the front edge of the cover or from the top edge of the front wall or from the top edge of a side wall has a longer length and/or width, and thereby consumes more material than blanks without such flaps. Therefore, it would be advantageous for a blank to have no flaps extending from the front edge of the cover, top edge of the front wall, and top edge of a side wall.

Finally, it would be advantageous for the blank of a particular pizza box to be of such design that it can be manufactured in multiple blanks in an inverted-and-mated configuration, as this saves on the amount of material needed to manufacture the blanks as compared to similar blanks that cannot be mated. Blanks that have cover flaps extending from left and right sides of the cover, or that have side walls extending the full length of the box bottom, are not conducive to manufacturing in inverted-and-mated configuration for a substantial material savings. In short, a blank that allows for inverting-and-mating can offer the opportunity to save a substantial amount of material and cost in pizza box manufacturing.

In addition, it is advantageous for a pizza box to be eight-sided, or octagonal in shape, as this minimizes slice sliding during transport and enhances heat retention of the product by limiting the amount of air space in the container (as compared to 4-sided and 6-sided boxes). Lastly, a blank of an 8-sided box is narrower than the blank of a 6-sided box and, therefore, provides a savings in material and cost over a 6-sided box.

The prior art pertaining to blanks for one-piece octagonal boxes includes the following: Schaller U.S. Pat. No. 2,706,592 granted Apr. 19, 1955; Sauer U.S. Pat. No. 2,819,833 granted Jan. 14, 1958; Zukoski U.S. Pat. No. 2,925,213 granted Feb. 16, 1960; Robinson U.S. Pat. No. 3,512,697 granted May 19, 1970; Zion et al. U.S. Pat. No. 4,765,534 granted Aug. 23, 1988; Nunn U.S. Pat. No. 4,793,546 granted Dec. 27, 1988; Deiger U.S. Pat. No. 5,000,374 granted Mar. 19, 1991; Goudreau U.S. Pat. No. 5,351,880 granted Oct. 4, 1994; and an Italian patent 680781. In addition, a blank exists for a non-patented octagonal pizza box currently used by a pizza company.

Each of the above references is of such structure that three or more blanks cannot be manufactured in an inverted-and-mated configuration, for maximum material savings. In addition, each reference has at least one flap or panel projecting from (a) the front edge of the cover and/or (b) the top edge of the front wall and/or (c) a top edge of one of the side walls, thereby increasing the length and/or width of the blank and, as a result, the amount of material needed to manufacture the blank.

In the prior art there is shown several blanks that allow manufacture of multiple blanks in an inverted-and-mated configuration. They include Schurmann U.S. Pat. No. 1,634,596 granted Jul. 5, 1927; Ringler U.S. Pat. No. 3,003,675 granted Oct. 10, 1961; and Foster U.S. Pat. No. 3,572,576 granted Mar. 30, 1971.

However, all of the above references pertain exclusively to four-sided boxes and none of them show a blank for an octagonal box that has a structure that allows manufacturing multiple blanks in an inverted-and-mated configuration for a cost savings. Further, all of the references show a blank with a flap on the front edge of the cover or on the top edge of the front wall or on the top edge of a side wall, thereby showing a blank that uses more than a minimum of material.

So, there has been a problem in manufacturing a cost-effective blank for a one-piece octagonal box. This problem has not been solved by the prior art but is solved by my invention, whereby three or more blanks for a one-piece octagonal box can be manufactured in inverted-and-mated configuration for optimal savings in material and cost. In addition, unlike the above prior art references, my blank can be made without any flap projecting from the front edge of the cover or from the top edge of the front wall or from the top edge of a side wall, thereby creating an octagonal box blank with the shortest possible length and width which, as a result, consumes a minimum amount of material in manufacture.

In conclusion, it would be highly desirable to provide a type of blank for a one-piece octagonal box in which three or more blanks can be manufactured in an inverted-and-mated configuration for an optimal savings in material and cost, and in which the length and width dimensions are as short as possible to further reduce material consumption and cost.

OBJECTS AND ADVANTAGES

Accordingly, the first object of my invention is a blank for a one-piece octagonal box that can be manufactured in multiple units in an inverted-and-mated configuration, thereby providing a substantial savings in material and cost.

A second object of my invention is a blank for a one-piece octagonal box that has no flap projecting from the front edge of the cover or from the top edge of the front wall or from the top edge of parallel left and right side walls, thereby producing a blank with the shortest possible length and width which can be manufactured with a minimum of material and cost.

Further objects and advantages of the invention will become apparent from consideration of the following detailed description, related drawings, and appended claims.

SUMMARY OF THE INVENTION

In accordance with the invention, a blank for a one-piece octagonal box is provided. The blank has a bottom panel with front and rear edges, left and right edges, and first, second, third, and fourth diagonal edges. There are front and rear walls hingedly attached to the bottom panel and a cover hingedly attached to the rear wall. In its optimal configuration, the cover has a front edge and first and second diagonal edges with cover flaps hingedly attached to the diagonal edges, and the front edge of the cover and the top edge of the front wall are free of attachment, and none of the cover flaps extend beyond any of the outermost front, left, and right cover edges by a distance of more than three-fourths of the height of the rear wall.

A complete understanding of the invention can be obtained from the detailed description that follows.

LIST OF REFERENCE NUMERALS

Figure 1:
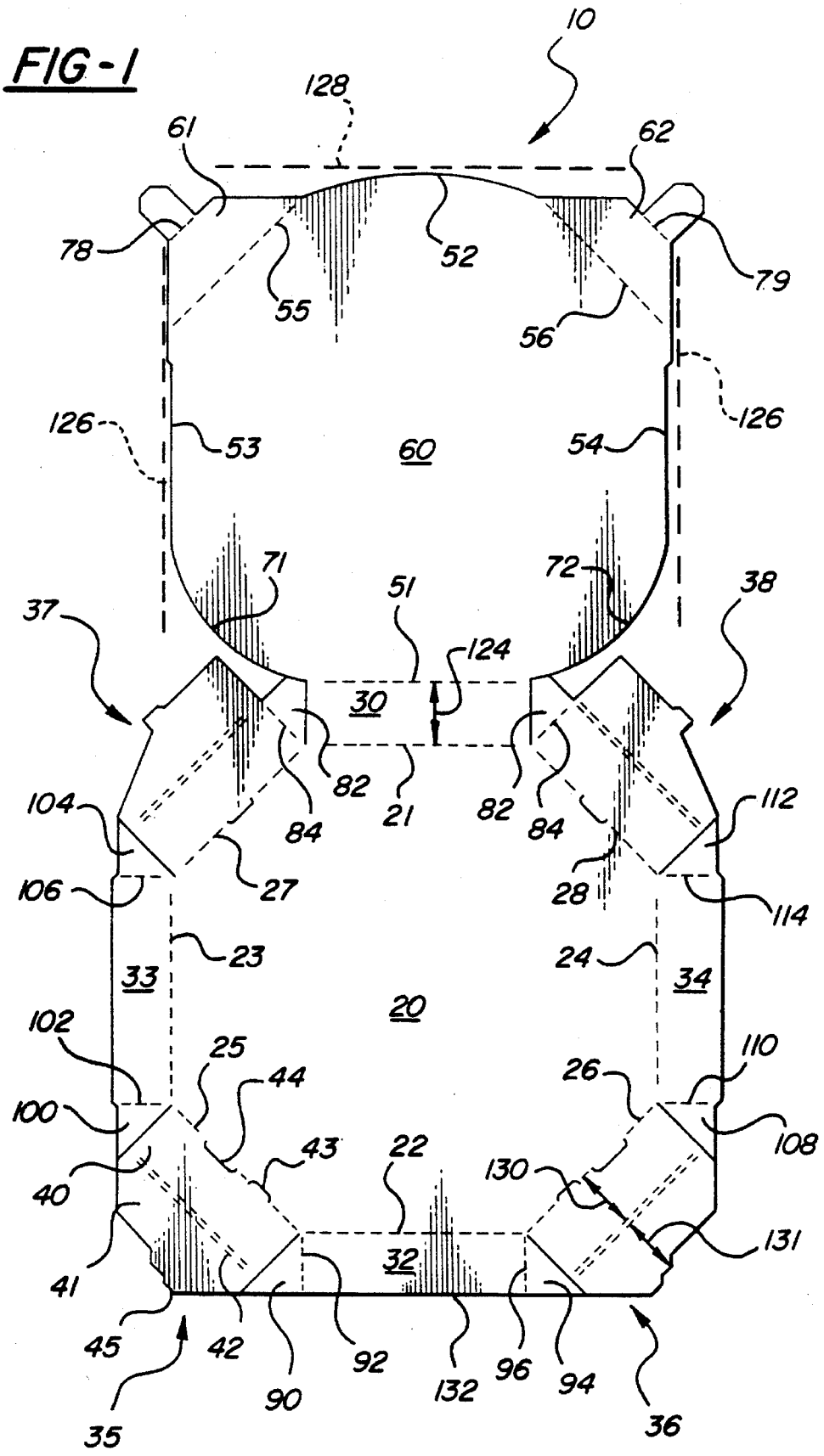
FIG. 1 is a plan view of a blank of the first embodiment of the invention.

10 blank of first embodiment
12 blank of second embodiment
14 optional cover for first embodiment
20 bottom panel
21 rear edge
22 front edge
23 left edge
24 right edge
25 first diagonal edge
26 second diagonal edge
27 third diagonal edge
28 fourth diagonal edge
30 rear wall
32 front wall
33 left wall
34 right wall
35 first double-panel diagonal wall structure
36 second double-panel diagonal wall structure
37 third double-panel diagonal wall structure
38 fourth double-panel diagonal wall structure
40 outer panel
41 inner panel
42 two narrowly-spaced parallel fold lines
43 slot-forming slit
44 slot-forming slit
45 tab
46 cut-out section
51 cover fold line
52 front cover edge
53 left cover edge
54 right cover edge
55 first diagonal cover edge
56 second diagonal cover edge
57 third diagonal cover edge
58 fourth diagonal cover edge
60 cover panel
61 cover flap
62 cover flap
63 cover flap
64 cover flap
65 adjacent edge
66 adjacent edge
67 adjacent edge
68 adjacent edge
71 curved rear corner edge
72 curved rear corner edge
73 edge
74 edge
75 edge
76 edge
78 intraflap fold line
79 intraflap fold line
82 flap
84 fold line
90 flap
92 fold line
94 flap
96 fold line
100 flap
102 fold line
104 flap
106 fold line
108 flap
110 fold line
112 flap
114 fold line
120 adjacent corresponding inner panels
124 height of rear wall
126 outermost lateral line of cover
128 outermost front line of cover
130 height of outer panel
131 height of inner panel
132 top edge of front wall

DESCRIPTION OF THE PREFERRED EMBODIMENTS

Figure 3:
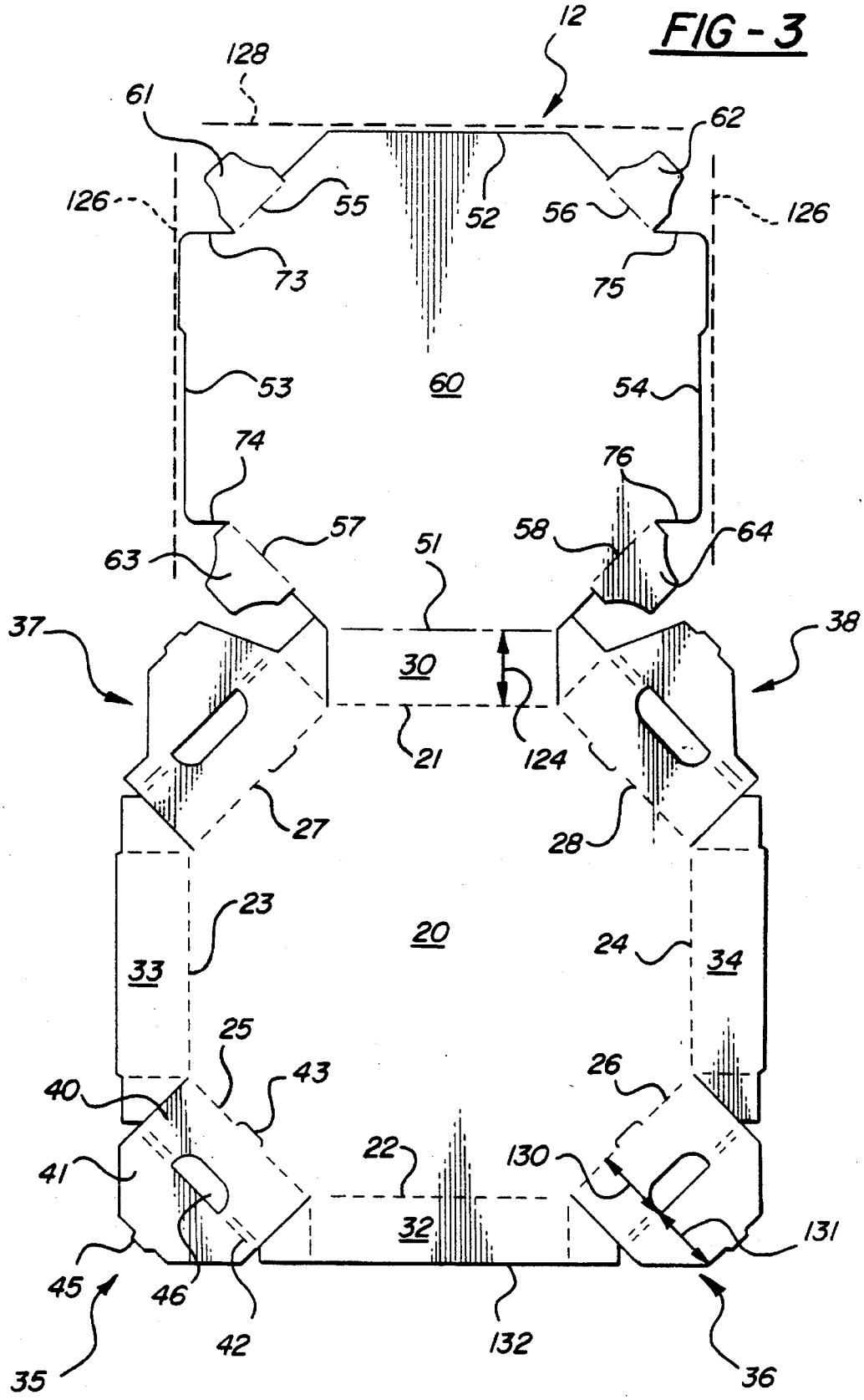
FIG. 3 is a plan view of a blank of the second embodiment of the invention.

Referring now to the drawings, there is illustrated two preferred embodiments of my invention, made of corrugated paperboard, depicted as blanks 10 and 12 shown in FIGS. 1 and 3, respectively. Except where noted, all labeled components of blank 10 also correspond to blank 12, even though all numerals are not shown in blank 12. It will be appreciated, as the description proceeds, that my invention may be realized in different embodiments and may be used in other applications.

Referring to FIG. 1, there is shown a blank 10 with a bottom panel 20 which has a rear edge 21, a front edge 22, opposing left and right edges 23 and 24, respectively, opposing first and second diagonal edges 25 and 26, respectively, and opposing third and fourth diagonal edges 27 and 28, respectively.

A rear wall 30, front wall 32, and left and right walls 33 and 34, respectively, are hingedly attached to bottom panel 20 at edges 21, 22, 23, and 24, respectively. Front wall 32 has a top edge 132.

First, second, third, and fourth double-panel diagonal wall structures 35, 36, 37, and 38, respectively, are hingedly attached to bottom panel 20 at edges 25, 26, 27, and 28, respectively. These four multi-panel structures comprise a set of common elements. As such, reference numerals are shown only for structure 35. However, it is understood that the corresponding elements in structures 36, 37, and 38 carry the same reference numerals as the elements of structure 35, even though the numerals are not shown.

The common components of double-panel structures 35, 36, 37, and 38 are a first panel 40 and a second panel 41 hingedly linked together at their top edges by a pair of narrowly-spaced parallel fold lines 42. In the embodiments, panels 40 and 41 are identified as outer and inner panels, respectively. Although panels 40 and 41 are shown being linked together by parallel fold lines, they could also be linked by a single fold line, instead. Along each of edges 25–28 is slot-forming slit 43 which extends slightly into bottom panel 20. When the blank is set up into a box, slit 43 opens up, forming a slot in bottom panel 20 into which tab 45 is inserted, thereby holding inner panel 41 parallel to outer panel 40 to form a double-panel diagonal wall. For a cover interlock in blank 10, there is also slot-forming slit 44 at each of edges 25 and 26 which extends slightly into outer panel 40. When the blank is set up into a box, slit 44 opens up, forming a slot at the bottom of panel 40 into which a cover flap is inserted. For an alternate cover interlock, blank 12 which is depicted in FIG. 3 shows a cut-out section 46 in outer panel 40. When the blank is set up into a box, section 46 receives a cover flap which is held between panels 40 and 41.

Figure 5:
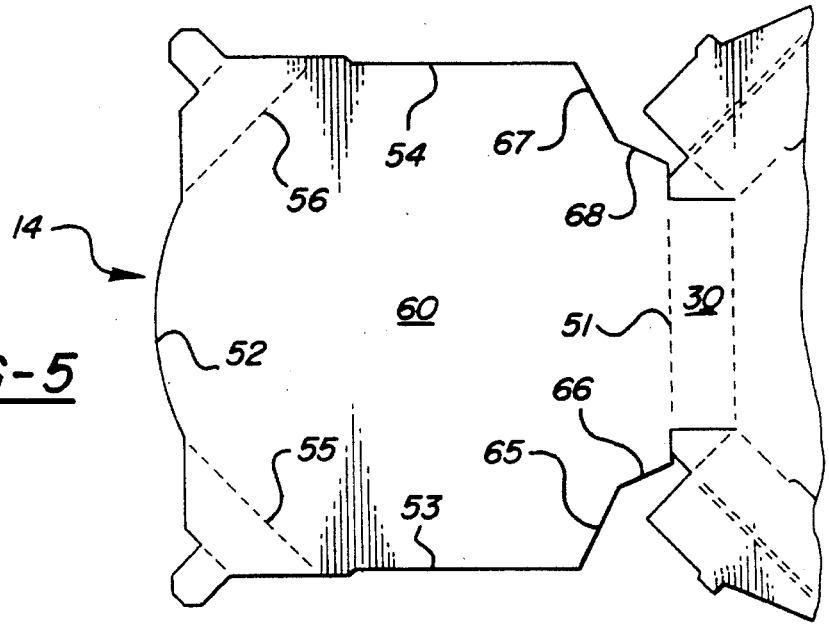
FIG. 5 is a plan view of an alternate cover configuration for the embodiment shown in FIG. 1.

Cover panel 60 is hingedly attached to the top edge of rear wall 30 at cover fold line 51. The cover has a front cover edge 52, left and right cover edges 53 and 54, respectively, and first and second diagonal cover edges 55 and 56, respectively. The cover of blank 10 has curved rear corner edges 71 and 72, respectively. The cover of blank 12 has third and fourth diagonal cover edges 57 and 58, respectively. The cover of blank 12 also has additional edges 73, 74, 75, and 76. There is shown in FIG. 5 an optional cover configuration which is a variation on blank 10. It has a pair of adjacent edges 65 and 66 and a pair of adjacent edges 67 and 68 in place of curved rear corner edges 71 and 72, respectively. It is noted, as shown in the drawings, that a cover edge may be either straight or curved.

Cover flaps 61 and 62 are hingedly attached to cover 60 at diagonal cover edges 55 and 56, respectively. In blank 10, flaps 61 and 62 are comprised of two parts hingedly joined by intraflap fold lines 78 and 79, respectively, which are approximately parallel to cover edges 55 and 56, respectively. When the blank is set up into a box, it is the smaller part of flaps 61 and 62 which is tucked into the slot created by slot-forming slit 44 in wall structures 35 and 36. In blank 12, flaps 61 and 62 are each comprised of one part. In addition, blank 12 has flaps 63 and 64 which are hingedly attached to edges 57 and 58, respectively. When the blank is set up into a box, flaps 61, 62, 63, and 64 are tucked into cut-out section 46 of diagonal wall structures 35, 36, 37, and 38, respectively.

Panels 40 and 41 each have a height that is the distance between their top and bottom edges. This height is indicated by dimensional lines 130 and 131, respectively, which are shown in wall structure 36. The height of the panels is approximately equal. Also, rear wall 30 has a height that is the distance between edge 21 and cover fold line 51. This height is indicated by dimensional line 124.

There are outermost left and right lateral lines 126 of cover 60 (shown in dashes) and outermost front line 128 (in dashes). The outermost front line 128 is a line that is parallel to cover fold line 51 and is tangential with the outermost front point of cover 60. The outermost left and right lateral lines 126 are lines that are perpendicular to outermost front line 128 and are tangential with the outermost left and right points, respectively, of cover 60.

To maintain the walls in vertical position when the blank is folded into a box, wall flaps are employed. At opposing ends of front wall 32 are flaps 90 and 94 hingedly attached at fold lines 92 and 96, respectively. Flaps 90 and 94 are received between panels 40 and 41 of wall structures 35 and 36, respectively, when the blank is folded into a box. At opposing ends of wall 33 are flaps 100 and 104 hingedly attached at fold lines 102 and 106, respectively. Flaps 100 and 104 are received between panels 40 and 41 of structures 35 and 37, respectively. At opposing ends of wall 34 are flaps 108 and 112 hingedly attached at fold lines 110 and 114, respectively. Flaps 108 and 112 are received between panels 40 and 41 of structures 36 and 38, respectively. Outer panel 40 of structures 37 and 38 has a flap 82 hingedly attached at a fold line 84.

Set-up of the Blank into a Box

To set up a box from the blank, the following procedure is used. First, simultaneously fold left and right walls 33 and 34 to upright position. Second, fold front wall 32 to upright position. Third, erect diagonal wall structure 35 by folding outer panel 40 to upright position and then folding inner panel 41 downward until tab 45 slides into slot 43. Fourth, erect diagonal wall structures 36, 37, and 38, in that order, by repeating the same procedure. Finally, fold cover 60 over the box base and tuck the cover flaps into the appropriate slots or cut-out sections.

Manufacture of Multiple Blanks

To achieve minimum material usage in manufacturing blanks 10 and 12, the design of the cutting die must be such that it simultaneously produces two or more blanks side-by-side and aligned at the ends and with the inner panel 41 of diagonal wall structure 37 or 38 of a first blank disposed adjacent to the corresponding inner panel of a second blank. This type of inverted-and-mated configuration, as shown in FIGS. 2 and 4, provides the opportunity to produce three or more one-piece octagonal box blanks per cutting die using a minimum of material.

Figure 2:
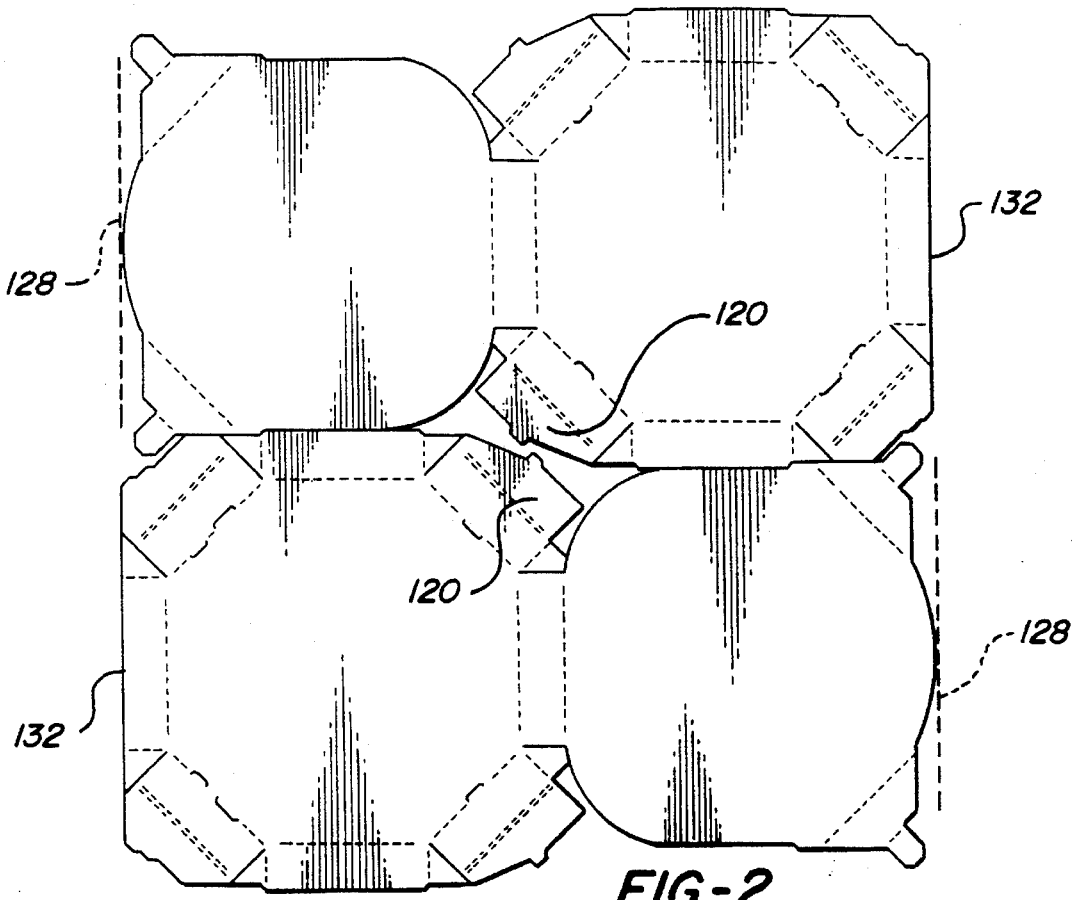
FIG. 2 is a plan view of multiple blanks of FIG. 1 in inverted-and-mated configuration, as they would be produced from a cutting die.
Figure 4:
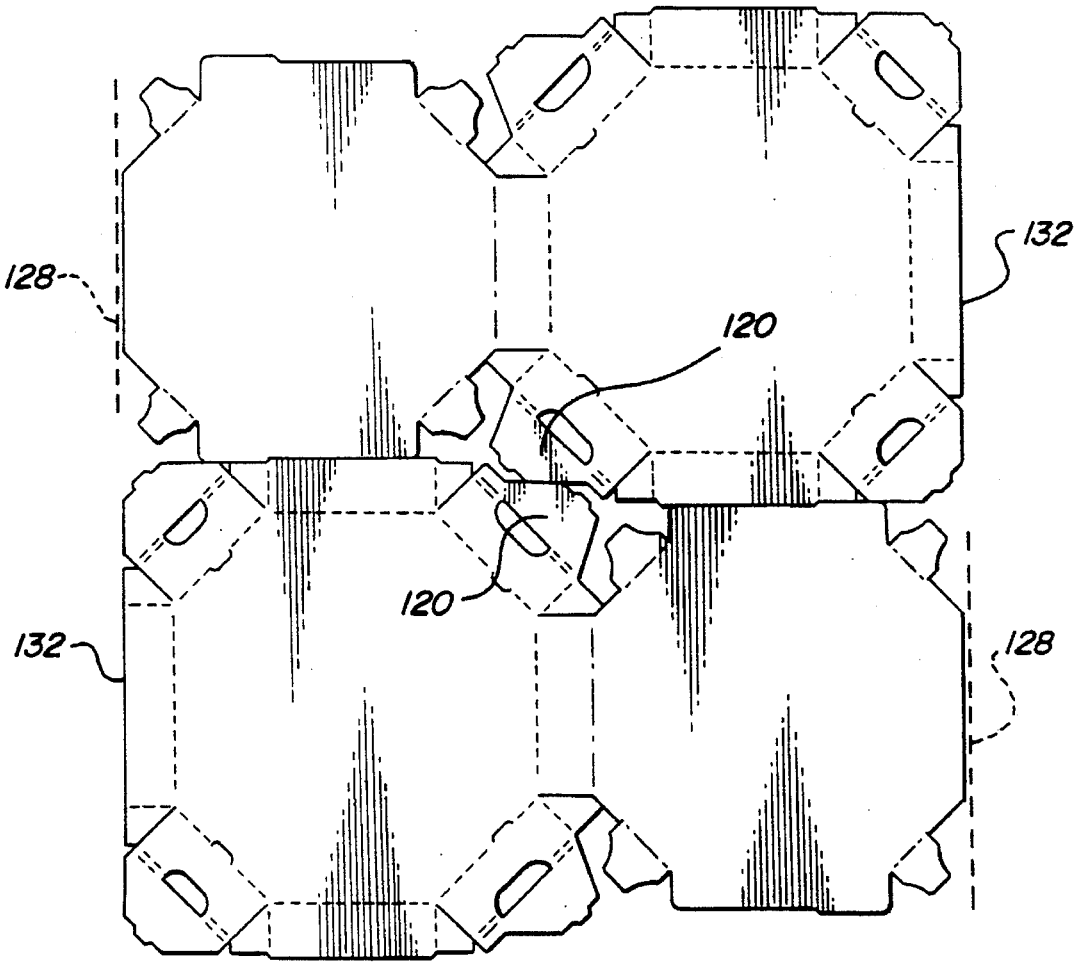
FIG. 4 is a plan view of multiple blanks of FIG. 3 in inverted-and-mated configuration, as they would be produced from a cutting die.

In FIGS. 2 and 4, the adjacent corresponding inner panels are indicated by numeral 120. These panels may be touching as shown in FIG. 4 or may be slightly separated but still adjacent one another as shown in FIG. 2. Further, when adjacent blanks are aligned at the ends, it is the furthermost extremities of the adjacent blanks which are aligned. In the embodiments, the furthermost extremities are edges 132 and 52. However, it is possible to have a flap or a tab extending further than edge 132 or 52, in which case the outermost point on the flap or tab would be the furthermost extremity.

For brevity of definition, a blank that has a structure that allows it to be manufactured for a material savings in inverted-and-mated configuration with two adjacent blanks, one on each side, and with the end edges of all three blanks aligned, is called a "double-matable, alignable blank." The embodiments of the invention are double-matable, alignable blanks. More specifically, the embodiments of the invention each disclose a double-matable, alignable blank for a one-piece octagonal box (i.e., a box having a bottom panel, eight walls, and a cover panel hingedly attached to one of the walls).

To align adjacent blanks for smaller pizza boxes (i.e., approximately 14-inch size and under), it may be necessary to shape adjacent inner panels 120 into substantially non-rectangular shape, as shown in FIGS. 2 and 4. However, it is possible to form adjacent panels 120 on larger boxes into a nearly rectangular shape.

Fold Lines

Within the context of this invention, a fold line can be created by a number of means such as, for example, by a crease or score in the board, by a series of aligned spaced short slits in the board, and by a combination of aligned spaced short and long slits. In some cases, when a longer slit is bounded on the ends by a series of shorter slits or a score, the longer slit may be slightly offset in alignment from the shorter slits or score for the purpose of creating a slot along the fold line when the blank is set up into a box. Such an offset slit may be referred to herein as a "slot-forming slit." Nonetheless, the entire combination of long and short slits is considered to constitute a single fold line unless otherwise indicated. In addition, to create a fold line where one panel is folded 180° to lay parallel on another panel, the fold line may constitute two narrowly-spaced parallel scores or series of aligned slits. In this case, the two narrowly-spaced parallel scores or series of aligned slits constitute a single fold line unless otherwise indicated. In conclusion, as referred to herein, a fold line is any line between two points on the blank or box along which the board is intended to be folded when the blank is being erected into a box. The type of fold lines shown in the drawings are presently preferred but it will be appreciated that other methods known to those skilled in the art may be used.

CONCLUSION, RAMIFICATIONS, AND SCOPE

I have disclosed a type of blank for a one-piece octagonal box. Due to its unique structure, my blank can be configured to allow the manufacture of multiple blanks in an inverted-and-mated format for a substantial savings in material and cost. In addition, the unique structure of my blank allows it to be configured into a blank of shorter length and width than most other pizza box blanks, thereby providing further savings.

The illustrated number, size, shape, and placement of components represent the preferred embodiments; however, other combinations and configurations are possible within the scope of the invention.

In conclusion, it is understood that my invention is not to be limited to the disclosed embodiments but, on the contrary, is intended to cover various modifications and equivalent arrangements included within the spirit and scope of the appended claims.

I claim:

1. A double-matable, alignable blank for a one-piece octagonal box, said blank being of foldable material cut and scored to define:

(a) a bottom panel having front and rear edges, left and right edges, and first, second, third, and fourth diagonal edges, said front and rear edges being disposed approximately parallel one to another, said left and right edges being disposed approximately parallel one to another, the first diagonal edge being disposed between said front edge and said left edge, the second diagonal edge being disposed between said front edge and said right edge, the third diagonal edge being disposed between said rear edge and said left edge, and the fourth diagonal edge being disposed between said rear edge and said right edge, (b) a front wall, a rear wall, and left and right walls hingedly attached to said bottom panel at the front edge, rear edge, and left and right edges, respectively, each of the walls having top and bottom edges, (c) a cover panel hingedly attached to the top edge of said rear wall at a cover fold line, said cover panel having a plurality of cover edges including non-parallel first and second diagonal cover edges and parallel left and right free cover edges, and a plurality of cover flaps comprising first and second cover flaps hingedly attached at said first and second diagonal cover edges, respectively, (d) first, second, third, and fourth double-panel diagonal wall structures hingedly attached to said bottom panel at said first, second, third, and fourth diagonal edges, respectively, each said double-panel diagonal wall structure comprising an outer panel and an inner panel hingedly linked to said outer panel, said inner and outer panels each having top and bottom edges, the distance between said top and bottom edges of said inner panel being substantially the same as the distance between said top and bottom edges of said outer panel, whereby when said blank is folded into a box each said double-panel diagonal wall structure forms a double-panel wall, at least one of the inner panels of said third and fourth double-panel diagonal wall structures being non-rectangular.

2. The blank of claim 1 wherein:

said rear wall has a height "X" that is the distance between said top and bottom edges, said cover has an outermost front line which is defined as an imaginary line that is parallel to said cover fold line and is tangential with an outermost front point of said cover, said cover has outermost left and right lateral lines which are defined as imaginary lines that are perpendicular to said outermost front line and are tangential with outermost left and right lateral points, respectively, of said cover, none of the flaps of said plurality of cover flaps extend beyond any of the outermost front, left, and right lateral lines by a distance of more than three-fourths height "X".

3. The blank of claim 1 wherein:

said rear wall has a height "X" that is the distance between said top and bottom edges, said cover has an outermost front line which is defined as an imaginary line that is parallel to said cover fold line and is tangential with an outermost front point of said cover, said cover has outermost left and right lateral lines which are defined as imaginary lines that are perpendicular to said outermost front line and are tangential with outermost left and right lateral points, respectively, of said cover, none of the flaps of said plurality of cover flaps extend beyond any of the outermost front, left, and right lateral lines by a distance of more than one-fourth height "X".

4. The blank of claim 1 wherein:

said first and second cover flaps each consist of one part.

5. The blank of claim 4, said blank further comprising:

a cut-out section in the outer panel of said first and second double-panel diagonal wall structures, whereby when said blank is folded into a box each of said first and second cover flaps is received by a cut-out section.

6. The blank of claim 1 wherein:

said first and second cover flaps each comprise two parts hingedly joined at an intraflap fold line, said intraflap fold line being approximately parallel to one of said first and second diagonal cover edges.

7. The blank of claim 6, wherein said first and second cover flaps each by a predetermined length that is greater than said distance between said top and bottom edges of said outer panel, said blank further comprising:

first and second slot-forming slits disposed along said first and second diagonal edges, respectively, on said bottom panel, said first and second slot-forming slits extending slightly into the outer panel of said first and second double-panel diagonal wall structures, respectively, whereby when said blank is folded into a box a part of said first and second cover flaps is disposed within first and second slots, respectively, each slot being created from one of the slot-forming slits and disposed at the bottom of one of the outer panels.

8. The blank of claim 1 wherein:

said cover has left and right cover edges disposed approximately parallel one to another, a substantial portion of said left and right cover edges being free of attachment.

9. First and second blanks formed from a single sheet of foldable material, said blanks each having opposing ends and a furthermost extremity on each end, one of the furthermost extremities of the first blank being aligned with one of the furthermost extremities of the second blank;

wherein each of said blanks is cut and scored to define:

(a) a bottom panel having front and rear edges, left and right edges, and first, second, third, and fourth diagonal edges, said front and rear edges being disposed approximately parallel one to another, said left and right edges being disposed approximately parallel one to another, one of the diagonal edges being disposed between said front edge and said left edge, one of the diagonal edges being disposed between said front edge and said right edge, one of the diagonal edges being disposed between said rear edge and said left edge, and one of the diagonal edges being disposed between said rear edge and said right edge, (b) a front wall, a rear wall, and left and right walls hingedly attached to said bottom panel at the front edge, rear edge, and left and right edges, respectively, each of the walls having top and bottom edges, (c) a cover panel hingedly attached to the top edge of said rear wall at a cover fold line, said cover panel having a plurality of cover edges including non-parallel first and second diagonal cover edges and parallel left and right free cover edges, and a plurality of cover flaps comprising first and second cover flaps hingedly attached at said first and second diagonal cover edges, respectively, (d) first, second, third, and fourth double-panel diagonal wall structures hingedly attached to said bottom panel at said first, second, third, and fourth diagonal edges, respectively, each said double-panel diagonal wall structure comprising an outer panel and an inner panel hingedly linked to said outer panel, said inner and outer panels each having top and bottom edges, the distance between said top and bottom edges of said inner panel being substantially the same as the distance between said top and bottom edges of said outer panel, whereby when said blank is folded into a box each said double-panel diagonal wall structure forms a double-panel wall;

wherein at least one of the inner panels of the first blank is disposed adjacent to the corresponding inner panel of the second blank and one of the left and right free cover edges of the first blank adjoins the top edge of one of the left and right walls of the second blank.

10. The first and second blanks of claim 9 wherein:

said rear wall of each said blank has a height "X" that is the distance between said top and bottom edges, said cover of each said blank has an outermost front line which is defined as an imaginary line that is parallel to said cover fold line and is tangential with an outermost front point of said cover, said cover has outermost left and right lateral lines which are defined as imaginary lines that are perpendicular to said outermost front line and are tangential with outermost left and right lateral points, respectively, of said cover, none of the flaps of said plurality of cover flaps of each said blank extend beyond any of the outermost front, left, and right lateral lines by a distance of more than three-fourths height "X".

11. The first and second blanks of claim 9 wherein:

said cover of each said blank has left and right cover edges disposed approximately parallel one to another, a substantial portion of said left and right cover edges being free of attachment.

12. First and second blanks formed from a single sheet of foldable material:

wherein each of said blanks is cut and scored to define:

(a) a bottom panel having a rear edge, a front edge, and first, second,, third, fourth, fifth, and sixth side edges, said first and second side edges each being disposed non-adjacent to said rear edge and at an oblique angle to it, said third and fourth side edges each being disposed adjacent to said rear edge and at an oblique angle to it, said fifth side edge being disposed between the first and third side edges, said sixth side edge being disposed between the second and fourth side edges, said front edge being disposed between the first and second side edges, (b) a rear wall hingedly attached to said bottom panel at said rear edge, said rear wall having top and bottom edges and a height "X" that is the distance between said top and bottom edges, (c) a front wall hingedly attached to said bottom panel at said front edge, (d) first, second, third, and fourth side wall structures hingedly attached to said bottom panel at said first, second, third, and fourth side edges, respectively, each said side wall structure comprising an outer panel and an inner panel hingedly linked to said outer panel, said inner and outer panels each having top and bottom edges, the distance between said top and bottom edges of said inner panel being substantially the same as the distance between said top and bottom edges of said outer panel, at least one of the inner panels of said third and fourth side wall structures being substantially non-rectangular, (e) fifth and sixth ,side walls hingedly attached to said bottom panel at said fifth and sixth side edges, respectively, (f) a cover hingedly attached to the top edge of said rear wall at a cover fold line, said cover having an outermost front line which is defined as an imaginary line that is parallel to said cover fold line and is tangential with an outermost front point of said cover, said cover having outermost left and right lateral lines which are defined as imaginary lines that are perpendicular to said cover fold line and are tangential with outermost left and right lateral points, respectively, of said cover, (g) a plurality of cover flaps comprising first and second cover flaps hingedly attached to said cover at first and second cover flap fold lines, respectively, wherein said first and second cover flap fold lines are disposed at an oblique angle to said cover fold line and none of the flaps of said plurality of flaps extend beyond any of the outermost front, left, and right lateral lines by a distance of more than three-fourths height "X";

wherein said at least one of the inner panels of the first blank is disposed adjacent to the corresponding inner panel of the second blank.

13. The blank of claim 1, wherein the plurality of cover edges further comprises third and fourth diagonal cover edges and the plurality of cover flaps further comprises third and fourth cover flaps hingedly attached at said third and fourth diagonal cover edges, respectively.

14. A one-piece blank of foldable material cut and scored to define a bottom panel, a plurality of walls and wall structures, and a cover hingeally attached to a top edge of one of the walls, said bottom panel having front and rear edges, left and right edges, and first and second diagonal edges, said front and rear edges being disposed approximately parallel one to another, said left and right edges being disposed approximately parallel one to another, the first diagonal edge being disposed between said front edge and said left edge, and the second diagonal edge being disposed between said front edge and said right edge, said plurality of walls and wall structures comprising first and second double-panel diagonal wall structures hingedly attached to said bottom panel at said first and second diagonal edges, respectively, each of the double-panel diagonal wall structures comprising an outer panel and an inner panel hingedly linked to said outer panel, said inner and outer panels each having top and bottom edges, the distance between said top and bottom edges of said inner panel being substantially the same as the distance between said top and bottom edges of said outer panel, whereby when said blank is folded into a box each said double-panel diagonal wall structure forms a double-panel wall, first and second slot-forming slits disposed along said first and second diagonal edges, respectively, on said bottom panel, said first and second slot-forming slits extending slightly into the outer panel of said first and second double-panel diagonal wall structures, respectively, said cover comprising:

(a) a cover panel having a plurality of cover edges including first and second diagonal cover edges, (b) a plurality of cover flaps including first and second cover flaps hingedly attached to said first and second diagonal cover edges, respectively, said first and second cover flaps each comprising two parts hingedly joined at an intraflap fold line, said intraflap fold line being approximately parallel to one of said first and second diagonal cover edges, said first and second cover flaps each having a predetermined length that is greater than said distance between said top and bottom edges of said outer panel;

whereby when said blank is folded into a box a part of said first and second cover flaps is disposed within first and second slots, respectively, each slot being created from one of the slot-forming slits and disposed at the bottom of one of the outer panels.

15. The blank of claim 14 wherein said bottom panel has third and fourth diagonal edges, the third diagonal edge being disposed between said rear edge and said left edge and the fourth diagonal edge being disposed between said rear edge and said right edge.

* * * * *